US006589400B1

(12) United States Patent
Schimion et al.

(10) Patent No.: US 6,589,400 B1
(45) Date of Patent: Jul. 8, 2003

(54) APPARATUS FOR METAL COATING OF BANDS BY ELECTROPLATING

(75) Inventors: Werner Schimion, Hilchenbach (DE); Thomas Folke, Siegen (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/426,803

(22) Filed: Oct. 22, 1999

(30) Foreign Application Priority Data

Oct. 23, 1998 (DE) ..... 198 48 876

(51) Int. Cl.[7] ..... C25D 17/00
(52) U.S. Cl. ..... 204/206
(58) Field of Search ..... 204/206

(56) References Cited

U.S. PATENT DOCUMENTS 4,152,221 A * 5/1979 Schaedel ..... 177/230
4,240,881 A * 12/1980 Stanya ..... 204/211
4,536,264 A * 8/1985 Masuda et al. ..... 205/648
4,597,837 A * 7/1986 Oda et al. ..... 205/107
4,681,665 A * 7/1987 Guillermet et al. ..... 205/138
5,049,246 A * 9/1991 Hull et al. ..... 204/224 M
5,658,441 A * 8/1997 Spain et al. ..... 204/203

* cited by examiner

*Primary Examiner*—Nam Nguyen
*Assistant Examiner*—Erica Smith-Hicks
(74) *Attorney, Agent, or Firm*—Sidley Austin Brown & Wood, LLP

(57) ABSTRACT

An apparatus for metal coating of bands by electroplating, with a band running through an acidic electrolyte enriched with a metal, the apparatus including at least one insoluble anode extending parallel to the band and divided, in a running direction of the band, in a plurality of separate anode strips insulated from each other, an arrangement for feeding current to each separate anode strip for precipitating the metal from the electrolyte, with the current flowing from a respective anode strip to the band which forms a cathode, whereby the metal is precipitated onto a band surface, and elements for supplying each anode strip with protective current the voltage of which is so selected that formation of cathode regions on anode strips, which are not supplied with the precipitation current, is prevented.

3 Claims, 1 Drawing Sheet

APPARATUS FOR METAL COATING OF BANDS BY ELECTROPLATING

BACKGROUND OF THE INVENTION

1. Field of the Invention

The present invention relates to an apparatus for metal coating of bands by electroplating, with a band running through an acidic electrolyte enriched with a metal. The apparatus includes at least one insoluble anode extending parallel to the band and divided, in a running direction of the band, in a plurality of separate anode strips insulated from each other, and means for feeding current to each separate anode strip for precipitating the metal from the electrolyte, with the current flowing from a respective anode strip to the band which forms the cathode.

2. Description of the Prior Art

Usually, the anodes of such apparatuses are wider than a band to be coated in the apparatus. As a rule, for metal coating of the band, only those anode strips are supplied with current which are located either above or below the band. As a result, the anode strips, which are not supplied with current, can be subjected to corrosion. The danger of corrosion is particularly great for the anode strips which are arranged immediately adjacent to the anode strips which are supplied with current and on which both cathode and anode regions are formed. In the cathode regions of the anode strips, which are supplied with current, hydrogen is generated. The hydrogen can penetrate in the anode strips, in particular into the anode strips formed of titanium.

Accordingly, an object of the present invention is to provide, in an apparatus of the type described above, means which would prevent the danger of corrosion of the anode strips, the supply of precipitation current to which is interrupted.

SUMMARY OF THE INVENTION

This and other objects of the present invention, which will become apparent hereinafter, are achieved by providing means for supplying each anode strip with protective current the voltage of which is so selected that the formation of cathode regions on the anode strips, to which the supply of the current for precipitation of metal from the electrolyte is interrupted, is prevented.

The feeding of the protective current prevents the formation of the cathode regions on all of the anode strips. The protective current is so selected that practically no metal precipitation takes place on the anode strips to which the current supply is interrupted, and particularly, no edge growth on the band occur. To meet these requirements, the amount of the protective current is so selected that it constitutes from about 3% to about 10% of the precipitation current.

The protective current supply means can be formed, with small technical expenditures, from current resistors which connect adjacent anode strips. An additional advantage of this very simple solution consists in that even the outer anode strips, which are not supplied with current for precipitating the metal from electrolyte and which are spaced from the last of the anode strips supplied with the precipitation current, are subjected to the action of the protective current. The spacing corresponds to the drop of the voltage gradient. Therefore, the outer anode strips can be exposed to as small as possible protective current.

The novel features of the present invention, which are considered as characteristic of the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

The arrangement for forming an electric field shown in FIG. 1 consists of a plurality of separate anode strips 5*a*, 5*b* arranged above and below a treated band 2. The separate anode strips 5*a*, 5*b* are separated from each other by insulation strips 6*a*, 6*b* which project over the upper surfaces of the anode strips 5*a*, 5*b* in a direction toward the passing band.

Figure 1:
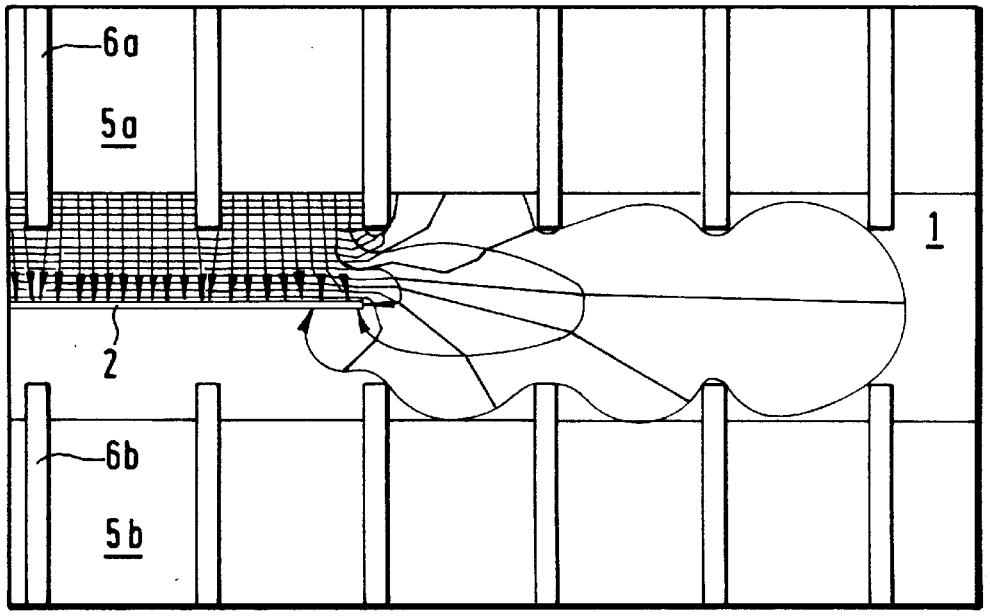
FIG. 1 a schematic view illustrating the formation of an electrical field in an apparatus according to the present invention during electroplating of a band.

Straight vertical lines in FIG. 1 show the flow of the precipitation current from anode strips 5*a* toward the band 2.

Figure 2:
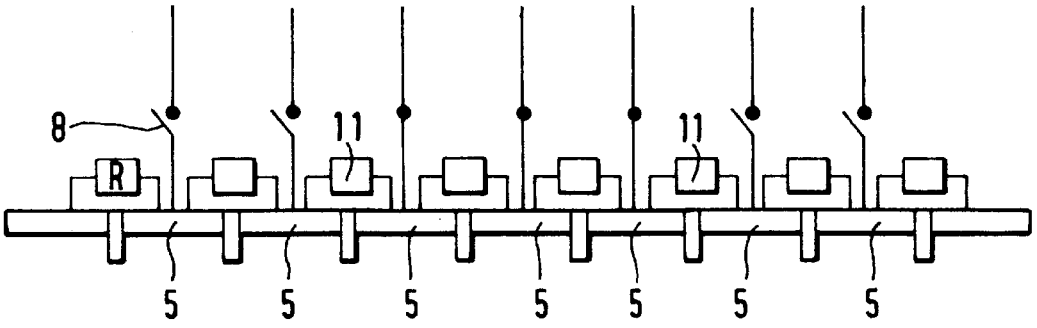
FIG. 2 a schematic view illustrating the supply of a protective current in the apparatus shown in FIG. 1.

As shown in FIG. 2, each separate anode strip 5 is connected by a respective switch 8 with a rectifier (not shown) which supplies to the anode strip 5 current for precipitating the metal from the electrolyte 1 onto the surface of the band 2 (precipitation current).

As shown in FIG. 2, three of the switches 8 are closed. The closed switches are associated with those anode strips which are arranged opposite the surface of the band 2 which is not shown in FIG. 2. At the adjacent anode strips, the switches of which are open, current overshooting, shown in FIG. 1 with curve arrows, takes place, without supply of the protective current according to the present invention. As a result, there are arranged, side by side, anode strips subjected to the action of the precipitation current and not subjected to the precipitation current. Thereby, cathode and anode regions are formed on the anode strips 5. In the cathode region, hydrogen is formed which can penetrate in the anode strips, which are formed of titanium, and lead to corrosion. Basically, the cathode and anode regions can be formed on all of the anode strips which are not subjected to the precipitation current.

As further shown in FIG. 2, the supply of the protective current takes place via resistors 11 which connect adjacent anode strips. As a result of the Series connection of the resistors 11, the further outer anode strips 5, which are not subjected to the action of the precipitation current, are also protected against a possible corrosion.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. An apparatus for metal coating of bands by electroplating, with a band running through an acidic electrolyte enriched with a metal, the apparatus comprising at least one insoluble anode extending parallel to the band and divided, in a running direction of the band, in a plurality of separate anode strips; means for insulating the separate anode strips from each other; means for feeding precipitation current to each separate anode strip for precipitating the metal from the electrolyte, wherein insulating regions between the anode strips are adapted for interrupting the precipitating current, with the current flowing from a respective anode strip to the band which forms a cathode, so that the metal is precipitated onto a band surface; and means for supplying each anode strip with protective current, the supplying means being adapted for supplying select voltage to prevent formation of cathode regions on the anode strips, wherein the protective current supplying means comprises electrical resistors which directly connect adjacent anode strips, and wherein the protective current constitutes from about 3% to about 10% of the precipitation current.

2. An apparatus for metal coating of bands by electroplating, with a band running through an acidic electrolyte enriched with a metal, the apparatus comprising at least one insoluble anode extending parallel to the band and divided, in a running direction of the band, in a plurality of separate anode strips; means for insulating the separate anode strips from each other; means for feeding precipitation current to each separate anode strip for precipitating the metal from the electrolyte, wherein insulating regions between the anode strips are adapted for interrupting the precipitating current, with the current flowing from a respective anode strip to the band which forms a cathode, so that the metal is precipitated onto a band surface; and means for supplying each anode strip with protective current, the supplying means being adapted for supplying select voltage to prevent formation of cathode regions on the anode strips, wherein the protective current supplying means includes a plurality of switches associated with respective anode strips for controlling current flow thereto, and wherein the protective current constitutes from about 3% to about 10% of the precipitation current.

3. An apparatus as set forth in claim 2, comprising at least one power source for supplying the protective current.

* * * * *